US009677734B2

(12) United States Patent
Albou

(10) Patent No.: US 9,677,734 B2
(45) Date of Patent: Jun. 13, 2017

(54) OPTICAL DEVICE, IN PARTICULAR FOR A MOTOR VEHICLE

(75) Inventor: Pierre Albou, Paris (FR)

(73) Assignee: Valeo Vision, Bobigny (FR)

( * ) Notice: Subject to any disclaimer, the term of this patent is extended or adjusted under 35 U.S.C. 154(b) by 413 days.

(21) Appl. No.: 14/240,585

(22) PCT Filed: Sep. 3, 2012

(86) PCT No.: PCT/EP2012/067068

§ 371 (c)(1),
(2), (4) Date: May 16, 2014

(87) PCT Pub. No.: WO2013/030396

PCT Pub. Date: Mar. 7, 2013

(65) Prior Publication Data

US 2014/0301100 A1 Oct. 9, 2014

(30) Foreign Application Priority Data

Sep. 2, 2011 (FR) ..... 11 57800

(51) Int. Cl.
*F21S 8/10* (2006.01)
*F21W 101/12* (2006.01)
(Continued)

(52) U.S. Cl.
CPC ..... *F21S 48/13* (2013.01); *F21S 48/115* (2013.01); *F21S 48/1154* (2013.01); *F21S 48/1163* (2013.01); *F21S 48/1225* (2013.01); *F21S 48/1329* (2013.01); *F21S 48/215* (2013.01); *F21S 48/225* (2013.01); *F21S 48/2212* (2013.01); *F21S 48/2262* (2013.01);
(Continued)

(58) Field of Classification Search
CPC .. F21S 48/115; F21S 48/1154; F21S 48/1163; F21S 48/1225; F21S 48/13; F21S 48/1329; F21S 48/215; F21S 48/2212; F21S 48/225; F21S 48/2262; F21S 48/2287; F21W 2101/12; F21W 2101/14; F21V 13/04; F21V 5/04; F21V 5/045
USPC ..... 362/545, 327, 511, 336, 520, 522, 555, 362/309, 308, 517, 217.04, 340
See application file for complete search history.

(56) References Cited

U.S. PATENT DOCUMENTS 4,270,454 A * 6/1981 Gill ..... F16C 13/00 101/348
5,704,709 A * 1/1998 Zwick ..... F21S 48/215 257/E33.072

(Continued)

FOREIGN PATENT DOCUMENTS

DE 202005010490 9/2005
EP 1698824 9/2006

(Continued)

*Primary Examiner* — Andrew Coughlin
*Assistant Examiner* — Arman B Fallahkhair
(74) *Attorney, Agent, or Firm* — Jacox, Meckstroth & Jenkins

(57) ABSTRACT

An optical device for a motor vehicle, notably a lighting and/or signaling device for a motor vehicle, comprising a surface light source, wherein the device comprises a light beam shaping member which deflects first light rays of the beam emitted by one face of the surface light source, this member not deflecting second light rays of the beam emitted by the same face of the surface light source.

19 Claims, 7 Drawing Sheets

(51) Int. Cl.
*F21W 101/14* (2006.01)
*F21Y 105/00* (2016.01)
*F21Y 115/15* (2016.01)

(52) U.S. Cl.
CPC ..... *F21S 48/2287* (2013.01); *F21W 2101/12* (2013.01); *F21W 2101/14* (2013.01); *F21Y 2105/00* (2013.01); *F21Y 2115/15* (2016.08)

(56) References Cited

U.S. PATENT DOCUMENTS 6,367,950 B1 * 4/2002 Yamada ..... F21S 48/215 362/241
7,270,454 B2 * 9/2007 Amano ..... F21S 48/215 362/328
7,290,906 B2 * 11/2007 Suzuki ..... B60Q 1/2696 362/328
7,410,274 B2 * 8/2008 Nagabuchi ..... F21S 48/215 362/299
7,837,359 B2 * 11/2010 Danek ..... F21V 5/04 362/309
8,007,150 B2 * 8/2011 Yagi ..... F21S 48/1154 362/520
8,314,546 B2 * 11/2012 Tchakarov ..... B32B 17/10155 313/504
8,562,191 B2 * 10/2013 Okada ..... F21S 48/215 362/309
8,591,083 B2 * 11/2013 Koizumi ..... B60Q 1/302 362/520
8,696,173 B2 * 4/2014 Urtiga ..... F21V 5/045 362/276
2005/0111235 A1 5/2005 Suzuki et al.
2006/0034094 A1 * 2/2006 Asada ..... F21S 48/215 362/545
2006/0198158 A1 9/2006 Nagabuchi
2011/0079772 A1 4/2011 Ben Khalifa et al.
2013/0021813 A1 1/2013 Godbillon

FOREIGN PATENT DOCUMENTS

FR 2926677 7/2009
FR 2955538 7/2011

* cited by examiner

OPTICAL DEVICE, IN PARTICULAR FOR A MOTOR VEHICLE

CROSS-REFERENCE TO RELATED APPLICATIONS

This application claims priority to PCT Application PCT/EP2012067068 filed Sep. 3, 2012, and also to French Application No. 1157800 filed Sep. 2, 2011, which are incorporated herein by reference and made a part hereof.

BACKGROUND OF THE INVENTION

1. Field of the Invention

The present invention relates to an optical device, notably for a motor vehicle, such as a lighting and/or signaling and/or interior lighting device, notably having a photometric function which is helpful for the use of the vehicle on the road in that it enables the vehicle to be seen by other vehicles or enables the driver of said vehicle to see outside the vehicle.

2. Description of the Related Art

In the field of signaling, as well as in that of lighting, numerous regulatory constraints allow little scope for changes in the appearance of the lights in the illuminated condition, since the photometric characteristics of the light beams are very closely specified. However, style and aesthetic factors are very important features of this type of product, and vehicle parts manufacturers try to provide their products with a "signature" which makes them easily recognizable by the end user.

It is known to use surface light sources to provide lighting and/or signaling and/or interior lighting functions for motor vehicles. A new type of surface light source is being developed at present, in the form of organic light-emitting diodes. It would be helpful to use these to provide lighting and/or signaling functions. However, these sources have some drawbacks. The degrees of directivity achieved at present are of the form $(\cos\theta)^{11}$, where $\theta$ represents the emission angle with respect to the normal to the emission surface and $(\cos\theta)^{11}$ represents the intensity of the light emitted in the direction $\theta$ relative to the intensity emitted in the direction of the normal to the surface. This degree of directivity is insufficient for the effective provision of certain signaling functions, notably a brake signaling function. This is because, in order to provide this signaling function, greater directivity is required in the vertical plane; in other words, the light emitted by the diode must be less diffused vertically.

To overcome this drawback, there are known organic light-emitting diodes that have a layer on their emitting surface for modifying their directivity. In this way, a directivity of the form $(\cos\theta)^{15}$ is achieved, where $\theta$ represents the emission angle with respect to the normal to the emission surface and $(\cos\theta)^{15}$ represents the degree of illumination in the direction $\theta$. By contrast with the situation described previously, this solution results in a directivity in the horizontal plane which is too great for the provision of a brake-type signaling function.

Consider a rectangular organic light-emitting diode having an emitting surface of 5 mm by 220 mm, positioned perpendicularly to an optical axis and having a global emission indicator of $\cos^{11}$ times the angle of observation with respect to its normal. This gives us the distribution at infinity shown in FIG. 1 (for an arbitrary flux of 50 lm). The horizontal and vertical sections are identical and have a profile varying as cosine$^{11}$. One of these sections is shown in FIG. 2. With this system, we obtain the photometric grid shown in FIG. 11. This photometric grid does not conform to the standardized photometric grid for a brake-type signaling device. This is because the luminous intensity emitted, notably, in the vicinity of the optical axis is insufficient when a large amount of light is emitted unprofitably above 15° upwards and below 15° downwards.

Additionally, the levels of luminance produced by organic light-emitting diodes are limited. It is therefore necessary to provide extended emission areas in order to obtain a lighting and/or signaling function.

SUMMARY OF THE INVENTION

The object of the invention is to provide an optical device which overcomes the aforementioned drawbacks and which improves the known optical devices of the prior art. In particular, the invention proposes a simple and inexpensive optical device enabling organic light-emitting diodes of limited dimensions to be used to provide lighting and/or signaling and/or interior lighting functions for a motor vehicle.

According to the invention, an optical device for a motor vehicle, notably a lighting and/or signaling and/or interior lighting device for a motor vehicle, comprises a surface light source and a light beam shaping member which deflects first light rays of the beam emitted by one face of the surface light source, this member not deflecting second light rays of the beam emitted by the same face of the surface light source.

The emission area of the surface light source may be greater than 1 $cm^2$, or greater than 5 $cm^2$, or greater than 10 $cm^2$.

The surface light source may comprise an organic light-emitting diode.

The optical device may comprise a housing closed by a closing outer lens, within which housing the surface light source and the shaping member are located.

The shaping member may be formed by a transparent one-piece component.

The shaping member may comprise a deflecting element which deflects the rays mainly by reflection.

The deflecting element may comprise a first reflecting element, notably a first flat reflecting element, and a second reflecting element, notably a second reflecting element with a parabolic section whose focus is at the position of the image of the center of the face seen via the first reflecting element, or substantially at the position of the image of the center of the face seen via the first reflecting element.

The shaping member may comprise a deflecting element which deflects the rays mainly by refraction.

The deflecting element may comprise an upper part and a lower part, the lower and upper parts being connected by a mechanical connecting element.

The first and second rays may pass through the shaping member.

Another object of the invention is a motor vehicle comprising an optical device as defined above.

These and other objects and advantages of the invention will be apparent from the following description, the accompanying drawings and the appended claims.

BRIEF DESCRIPTION OF THE ACCOMPANYING DRAWINGS

The attached drawing shows, by way of example, different embodiments of a lighting and/or signaling device for a motor vehicle according to the invention.

DETAILED DESCRIPTION OF THE PREFERRED EMBODIMENTS

Figure 1:
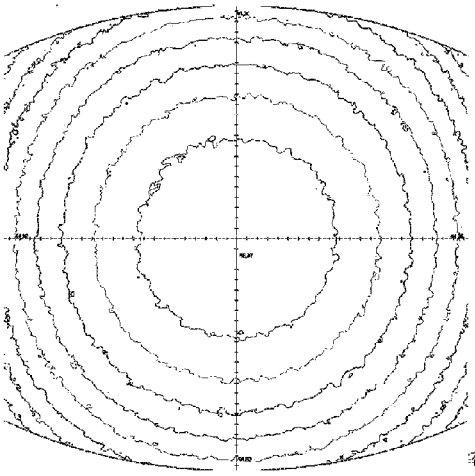
FIG. 1 is a diagram showing the distribution of illumination at infinity of a light source of the surface organic diode type, the different substantially concentric curves representing levels of illumination.
Figure 2:
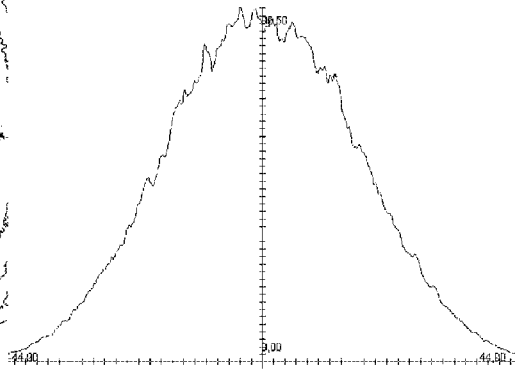
FIG. 2 is a diagram showing the variation of the intensity of illumination according to the angle formed between the normal to an emitting surface of a surface light-emitting diode and the direction of emission.
Figure 3:
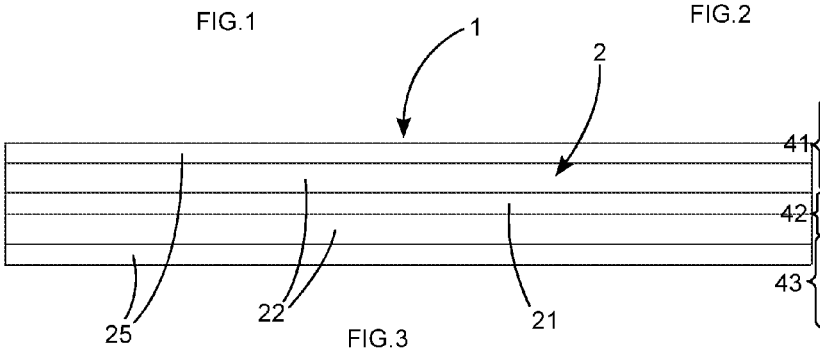
FIG. 3 is a face-on view of a first embodiment of an optical device according to the invention.
Figure 4:
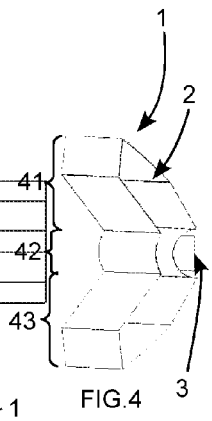
FIG. 4 is a perspective view of the first embodiment of the optical device according to the invention.
Figure 5:
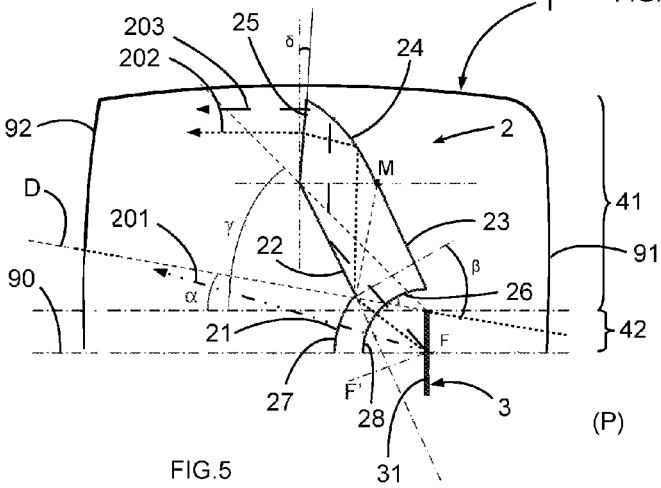
FIG. 5 is a perspective view in a vertical plane of the first embodiment of the optical device according to the invention.

A first embodiment is described below with reference to FIGS. 2 to 5. The optical device 1 is a lighting and/or signaling device for a motor vehicle, notably a brake signal light. The optical device 1 comprises a surface light source 3 and a light beam shaping member 2 which deflects first light rays 202, 203 (FIG. 5) of the beam emitted by one face 31 of the surface light source 3, this shaping member 2 not deflecting second light rays 201 of the beam emitted by the same face 31 of the surface light source 3.

The surface light source 3 is rectangular and elongated. For example, it measures about 220 mm in length and about 5 mm in height. The surface light source 3 is intended to be mounted so as to extend horizontally, with its light-emitting face 31 oriented vertically. The optical axis 90 of the optical device 1 is perpendicular to this light-emitting face 31. It cuts the surface light source 3 in the center of the height of the face, preferably in the center F of the light-emitting face 31.

The shaping member 2 is made of transparent material such as polymethyl methacrylate (PMMA). It is made, for example, by extrusion or molding. The shaping member 2 extends parallel to the length of the surface light source 3. For example, the cross section of the shaping member 2 remains constant over the whole length of the surface light source 3. Alternatively, the cross section may vary to create stylistic effects.

Figure 6:
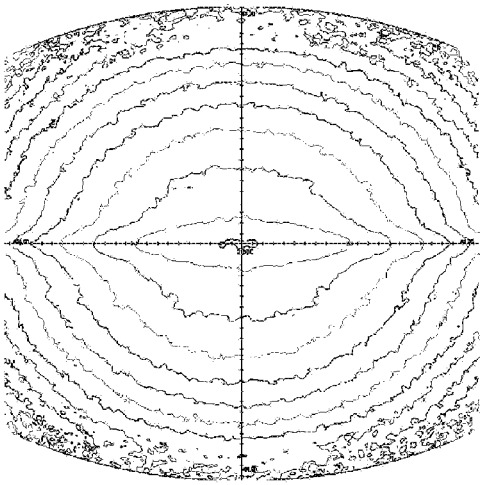
FIG. 6 is a diagram showing the distribution of illumination at infinity emitted by an optical device according to the invention.

The shaping member 2 comprises an upper part 41, a central part 42 (half of which is shown) and a lower part (not shown in FIG. 6). The lower part 43 (FIG. 4) is, for example, symmetrical to the upper part 42 with respect to the horizontal plane passing through the optical axis 90.

The upper part 41 forms a first assembly allowing rays emitted by the surface light source 3 to pass out of an output face 25 of the first assembly in a direction substantially parallel to the optical axis 90.

The lower part 43 forms a second assembly allowing rays emitted by the surface light source 3 to pass out of a second output face of the second assembly in a direction substantially parallel to the optical axis 90.

The central part 42 has the function of mechanically connecting the upper part 41 to the lower part 43. It is also made of transparent material so that rays emitted by the surface light source 3 can pass through it. This passage takes place without deflection (or without significant deflection) of the light rays emitted by the surface light source 3.

Figure 10:
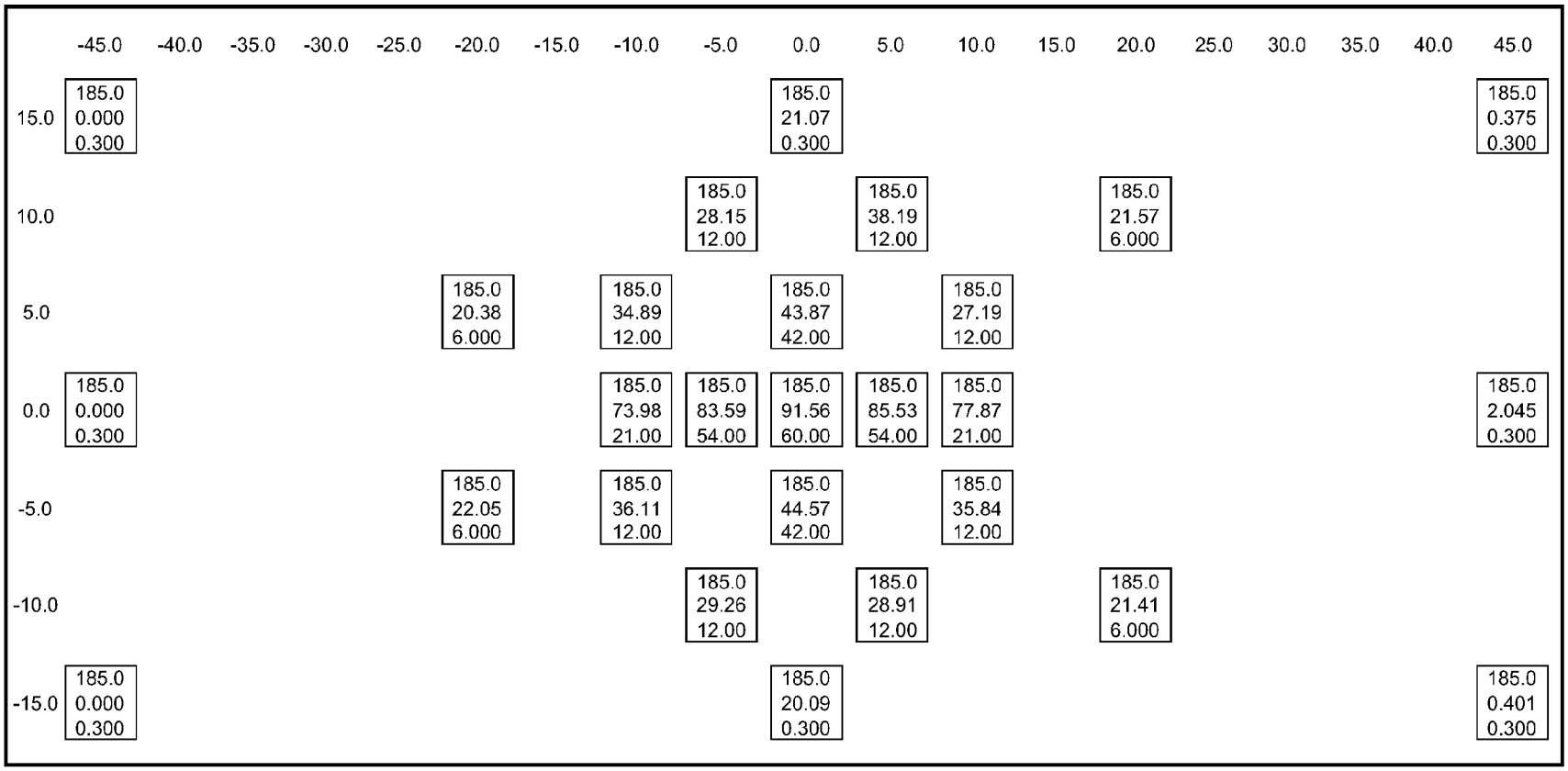
FIG. 10 shows a standardized photometric grid for a brake signal light and the values of luminous intensity found in this grid for an emitted luminous flux of 21 Im with an optical device according to the invention.
Figure 11:
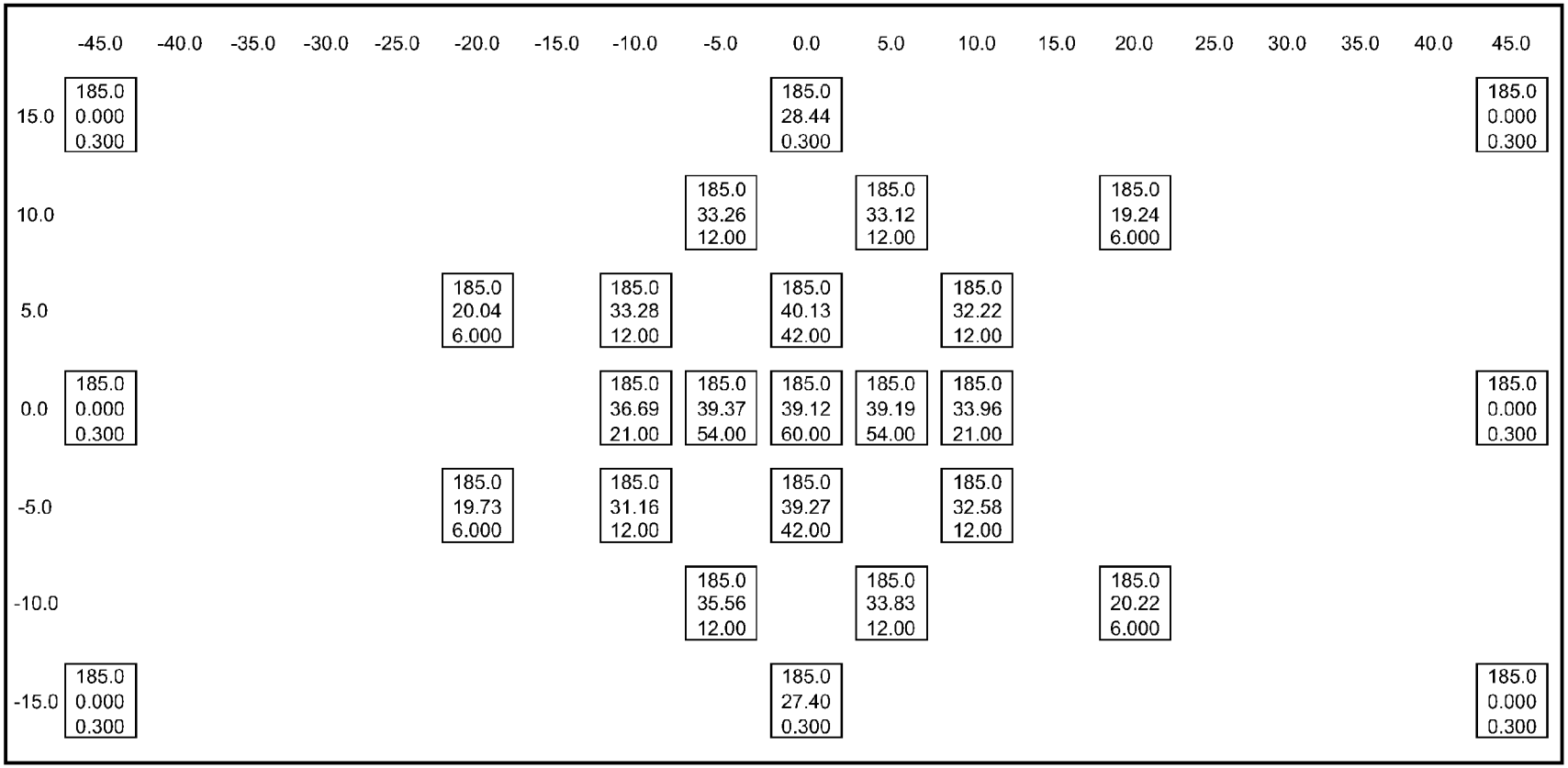
FIG. 11 shows a standardized photometric grid for a stop signal light and the values of luminous intensity found in this grid for an emitted luminous flux of 21 Im, using an organic light-emitting diode without any optical device for shaping its emitted beam.
Figure 12:
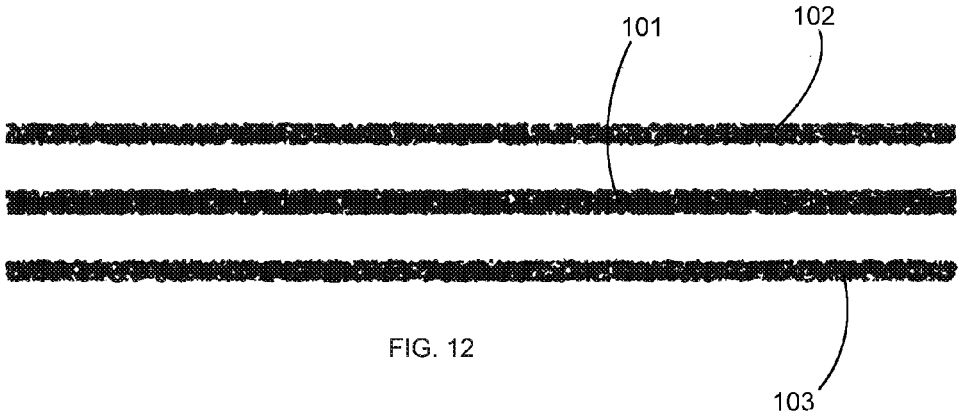
FIG. 12 shows the illuminated appearance of an optical device according to the invention, viewed from the optical axis of the device.
Figure 13:
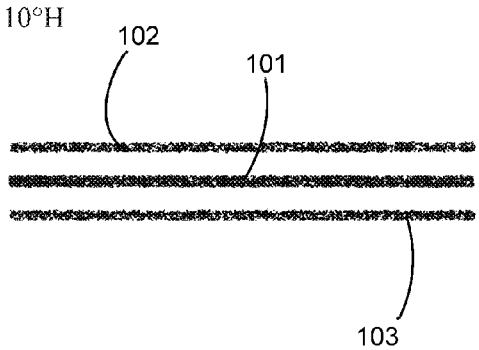
FIG. 13 shows the illuminated appearance of a device according to the invention, viewed at an angle of 10° to the optical axis in the horizontal plane.
Figure 14:
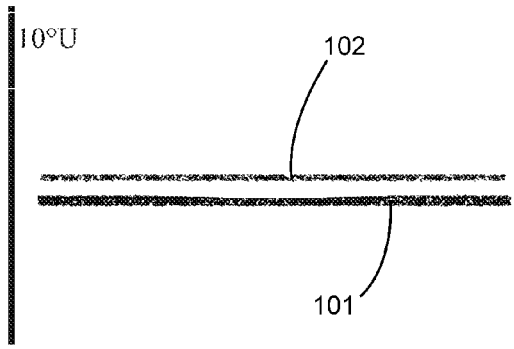
FIG. 14 shows the illuminated appearance of a device according to the invention, viewed at an angle of 10° to the optical axis in the vertical plane.
Figure 15:
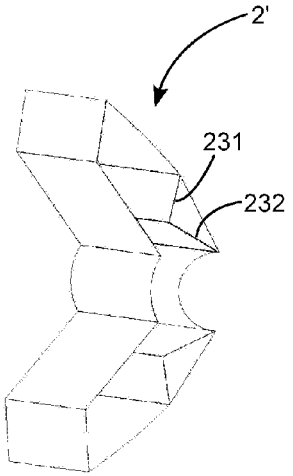
FIG. 15 is a perspective view of a second embodiment of the optical device according to the invention.
Figure 16:
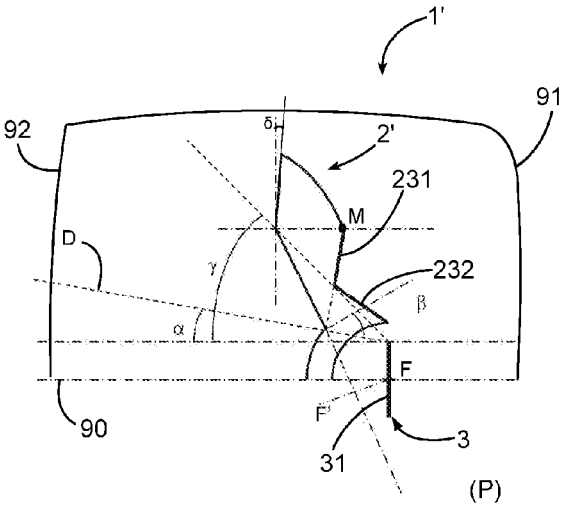
FIG. 16 is a sectional view in a vertical plane of the second embodiment of the optical device according to the invention.

Thus, by means of the beam shaping device, light is emitted from the output of the optical device 1 in three bands 101, 102, 103, as shown in FIG. 12. With this optical device 1 whose light source emits a light flux of 21 Im, the photometric grid shown in FIG. 10 is also obtained. Thus a brake signal device can be constructed with a light source of the organic light-emitting diode type, having the dimensions given above.

The first light rays 202, 203 emitted by the surface light source 3 form a sufficiently large angle with the optical axis 90 in the plane P to prevent them from passing through the central part 42 of the shaping member 2. This plane P is preferably a vertical plane normal to the face 31 of the surface light source 3. Thus, these first light rays are emitted toward the upper part 41 (or the lower part 43), enter this part at a surface 26, and are guided by the part as described below. When the rays are inside the upper part 41, a first reflecting element 22, formed for example by a face of the shaping member 2, deflects the rays by reflection. This reflection is obtained, for example, as a result of total reflection at an optical surface, the refractive index of the upper part being greater than that of the environment in which it is located. Alternatively, the first reflecting element 22 may be treated, by metal coating for example. Having been reflected, the first rays are reflected again by a second reflecting element 24, formed for example by a second surface. This reflection is obtained, for example, as a result of total reflection at an optical surface, the refractive index of the upper part being greater than that of the environment in which it is located. Alternatively, the second reflecting element 24 may be treated, by metal coating for example. A surface 23 is provided to connect the surface 26 to the second reflecting element 24.

The first reflecting element 22 is preferably flat and the second reflecting element 24 is, for example, cylindrical with a parabolic section, the focus F' of the parabola being at the position of the image of the center F of the face 31 seen via the first reflecting element 22.

Having been reflected, the first rays are again deflected if necessary by passing through an optical surface at the output surface 25 of the guide. In fact, this face may form an angle δ with the vertical plane.

The second light rays 201 emitted by the surface light source 3 form a sufficiently small angle with the optical axis 90 in the plane P to pass through the central part 42 of the shaping member 2. Thus these second light rays are emitted outside the shaping member 2, at the position of the central part 42. For this purpose, the second light rays pass through a first optical surface 28 as they enter the shaping member 2, then through a second optical surface 27 as they pass out of the shaping member 2. Consequently they pass out of the shaping member 2 at a face 21 formed by the second optical surface 27.

The three bands 101, 102 and 103 are in fact formed by the light rays passing out of the faces 21 and 25, and out of another face, which is not shown, of the lower part of the shaping member 2. Given the geometry of the shaping member 2, it should be noted that, when a viewer moves away from the optical axis 90 through 10° in a horizontal plane, all the bands remain visible. On the other hand, when a viewer moves away from the optical axis 90 through 10° in a vertical plane, the bands disappear. This is because, as shown in FIGS. 6 to 9, the shaping member 2 makes it possible to "straighten" the light rays emitted from the face 31 at a large angle with the optical axis 90 in the vertical plane P; in other words, this angle is reduced at the output of the shaping member 2. On the other hand, the direction of the light rays emitted by the face 31 at a large angle with the optical axis 90 in the horizontal plane is not corrected.

Figure 8:
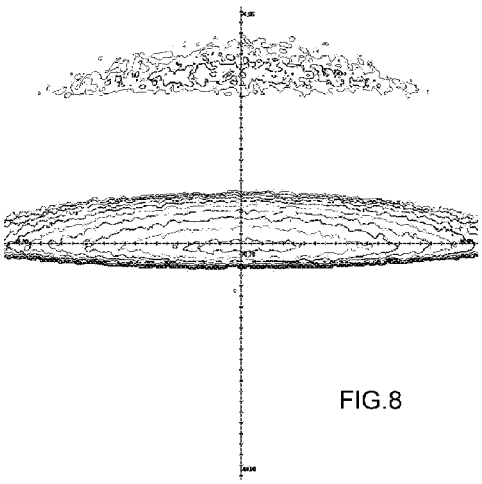
FIG. 8 is a diagram showing the distribution of illumination at infinity emitted by part of the light beam emerging from an optical device according to the invention.
Figure 7:
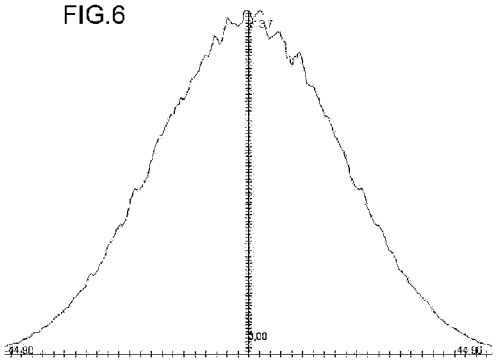
FIG. 7 is a diagram showing the variation of the intensity of illumination according to the angle formed between the normal to the optical axis of the optical device according to the invention and the direction of emission at the output of the optical device according to the invention for rays emitted in a horizontal plane containing the optical axis of the invention.
Figure 9:
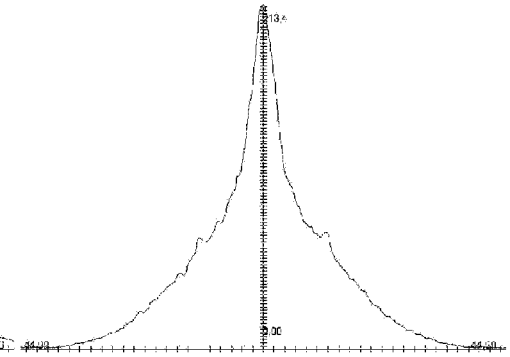
FIG. 9 is a diagram showing the variation of the intensity of illumination according to the angle formed between the optical axis of the optical device according to the invention and the direction of emission at the output of the optical device according to the invention for rays emitted in a vertical plane containing the optical axis of the invention.

For the global beam emitted from the optical device, the distribution at infinity shown in FIG. 6 is obtained. A horizontal section through this distribution is shown in FIG. 7. For the upper band 102 emitted from the optical device, the distribution at infinity shown in FIG. 8 is obtained. A vertical section through this distribution is shown in FIG. 9.

In the first embodiment of the optical device 1, the shaping member 2 is, for example, made as a single extruded part having a length greater than or equal to that of the surface light source 3 (220 mm in the example), with a cross section constructed as follows:

The cross section of the central part 42 is a portion of a ring with an internal radius r1 such that 2×r1 is greater than and (in order to minimize the overall dimensions of the system) preferably close to the height of the surface light source 3 (for example, if the surface light source 3 height is 5 mm, r1 can be made equal to 3.5 mm), and with an external radius r2 which is as small as possible while remaining compatible with the manufacture of the shaping member 2 and/or with its function as a mechanical connection between the upper part 42 and lower part 43 (for example, r2−r1=2.5 mm).

An angle α between a straight line D, passing through the upper edge of the organic light-emitting diode, and the optical axis 90 defines half of the vertical aperture of the field in which the surface light source 3 is fully visible in the central band. The rays seen in this field are not deflected by the shaping member 2. For example, α=5°.

An angle β between the straight line D and the normal to the first reflecting element 22 is greater than or equal (preferably equal, to minimize the overall dimensions of the shaping member 2) to the angle of total reflection in the material of the shaping member 2 (for PMMA, β=a sin(1/1.49), therefore β=42.2°). In these conditions, all the rays emitted from the surface light source 3 and striking the first reflecting means 22 undergo total reflection.

An angle γ above which, given the directivity of the surface light source 3, the emitted light may be considered negligible, in other words such that $$\frac{\int_{\gamma}^{\pi/2} \cos^k\varphi \cdot \sin\varphi \cdot d\varphi}{\int_{0}^{\pi/2} \cos^k\varphi \cdot \sin\varphi \cdot d\varphi}$$

is negligible relative to 1.

In the example, if k=11 and γ=37°, the above ratio is 0.067.

F' is the mirror image of F with respect to the plane of the first reflecting means 22.

M is the intersection of the internal reflection of the limit ray with an angle of α (emitted along the straight line D) and of the straight line parallel to the optical axis and passing through the upper edge of the first reflecting means 22 (this edge being determined by the limit ray with an angle of γ).

Finally, since the image of the surface light source 3 by reflection on the first reflecting means 22 is inclined with respect to the optical axis of the system, the maximum intensity of the beam created by the upper parabolic section is not necessarily located on the horizontal axis: a prism angle δ can be used to angularly offset the beam emerging from the upper band (for example, δ=6°).

Depending on the values of the chosen parameters, the reflection on the parabolic section may be a total internal reflection for all the rays (this is the case in the example considered here). If this is not so, the second reflecting element 24 may be metal-coated. The efficiency may be very slightly diminished in this case.

Figure 17:
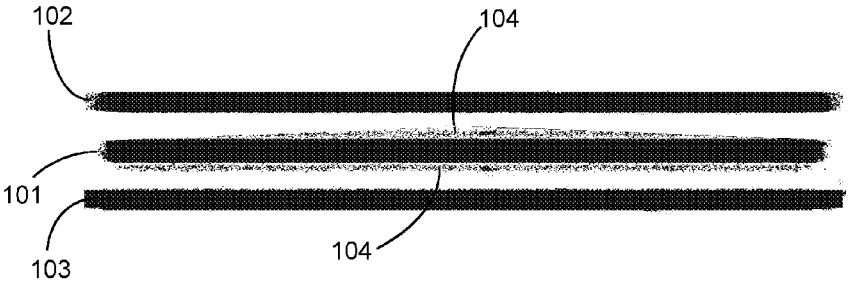
FIGS. 17 and 18 show the illuminated appearance of an optical device according to the second embodiment, viewed from the optical axis of the device.
Figure 18:
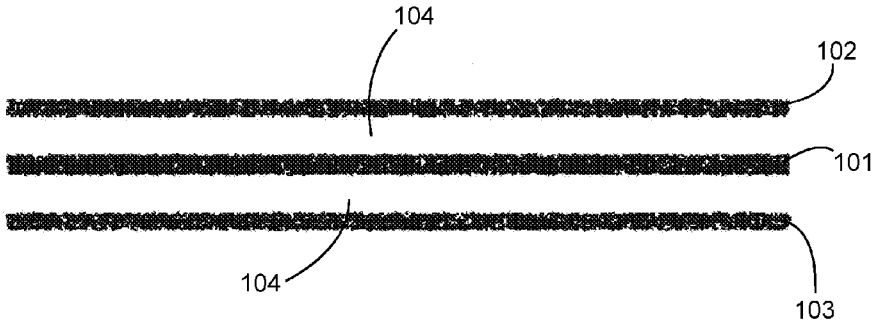

A second embodiment is described below with reference to FIGS. 15 to 18. This second embodiment of the optical device 1' differs from the first embodiment described above in that the surface 23 for connecting the surface 26 to the second reflecting element 24 (and having no optical function) is modified so as to create the diffusing surfaces 231 and 232. The aim is to use a diffusing surface 231 or 232 in order to create a luminous background between the bands 101, 102 and 103. For this purpose, some of the light rays must pass out of the shaping member 2 through the first reflecting element 22. In order to make this effect significant (or simply visible), this diffusing surface 232 should be given a suitable shape such that it cuts the rays emitted with an angle greater than the angle γ, but close to this angle (if the angle is more than 47°, in the present example, only 1% of the light flux is collected). These rays are reflected on the diffusing surface 232 before passing out of the shaping member 2 through the first reflecting element 22. As shown in FIGS. 17 and 18, this makes it possible to obtain light-emitting areas 104 of low intensity between the bands 101 and 102 and/or between the bands 101 and 103.

Figure 19:
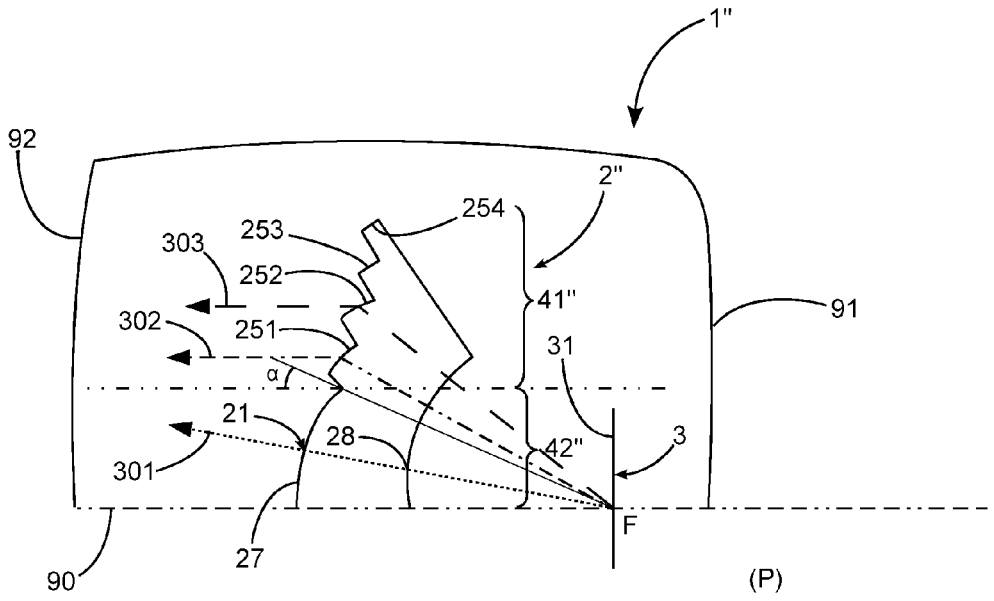
FIG. 19 is a sectional view in a vertical plane of a third embodiment of the optical device according to the invention.

A third embodiment is described below with reference to FIG. 19. This third embodiment of the optical device 1" differs from the first embodiment described above in that the light rays are deflected by refraction, instead of by reflection, in the upper 41" and lower parts. For this purpose, the upper and lower parts comprise optical surfaces 251, 252, 253 and 254. These optical surfaces 251, 252, 253 are, for example, cylinders whose cross sections are portions of Cartesian curves. The central part 42" may be identical to that described in the first embodiment.

The first light rays 302, 303 emitted by the surface light source 3 form a sufficiently large angle with the optical axis 90 in the plane P to prevent them from passing through the central part 42" of the shaping member 2. Thus these first light rays are emitted toward the upper part 41" (or the lower part) and enter this part at a surface 28. The first rays are then deflected as they pass through optical surfaces. For example, the ray 302 enters the upper part at the face 28 without being deflected and passes out of the upper part at the optical surface 251 while being deflected by the latter. Similarly, the ray 303 enters the upper part at the face 28 without being deflected and passes out of the upper part at the optical surface 252 while being deflected by the latter.

The second light rays 301 emitted by the source form a sufficiently small angle with the optical axis 90 in the plane P to pass through the central part 42 of the shaping member 2. Thus these second light rays are emitted outside the shaping member 2, at the position of the central part 42". For this purpose, the second light rays pass through a first optical surface 28 as they enter the shaping member 2, then pass through a second optical surface 27 as they pass out of the shaping member 2. Consequently they pass out of the shaping member 2 at a face 21 formed by the second optical surface 27.

Clearly, with this third embodiment, the viewer does not see three bands of light, but sees nine in the illustrated example, assuming that the lower part is symmetrical to the upper part.

These different embodiments may be combined unless they prove incompatible for technical reasons.

In the different embodiments, the second light rays are rays emitted, in projection on the plane P, in the sector delimited by the straight line D, its mirror image with respect to the optical axis 90, and the surface light source 3, and rays whose extensions only cut the straight line D or its mirror image after the optical surface 27. The projections of the first light rays on the plane P, in the sector, cut the straight line D or its mirror image with respect to the optical axis 90 cut the straight line D or its mirror image before the optical surface 27.

In the different embodiments, the optical device 1 comprises a housing 91 closed by a closing outer lens 92, within which housing the surface light source 3 and the shaping member 2 are located. The shaping member 2 is formed by a transparent one-piece component. The first and second rays pass through the shaping member 2. It is considered that the second rays passing through the central part 42 of the shaping member 2 are not deflected by the shaping member 2. In the described embodiments, this is true only of the light rays emitted from the longitudinal axis of the face 31. This is because a light ray emitted from the upper edge of the face 31 parallel to the optical axis 90 is slightly deflected as it passes through the first optical surface 28, and is then slightly deflected again as it passes through the second optical surface 27.

Preferably, in this document, it is considered that a ray is not deflected by the shaping member 2 if its projection in the plane P is not deflected by more than 5° by this shaping member 2. As a corollary, it is considered that a light ray is not deflected unless its projection in the plane P is deflected by more than 5°.

In the different embodiments, the optical device 1 is a lighting and/or signaling device comprising a housing 91 closed by an outer lens 92. The optical device 1 also has an optical axis 90.

In the different embodiments, the emission area of the surface light source is preferably greater than 1 $cm^2$, or greater than 5 $cm^2$, or greater than 10 $cm^2$.

In the different embodiments, the optical device 1 has elements for positioning and holding the surface light source 3 relative to the shaping member 2. The optical device 1 described above has a constant cross section along the whole of its length. However, it is conceivable that the geometry of its cross section may vary along the optical device 1. It is also conceivable that the optical device 1 may not be rectilinear as shown in the figures, but may have at least one curve.

The surface light source 3 may comprise a plurality of surface light-emitting elements, notably a plurality of organic light-emitting diodes.

The organic light-emitting diode may be of the conformable type. For example, it may be made in the form of a film that can be deposited on a surface, notably on a bent surface. Alternatively, it may be made by a method of printing the different layers, notably by a method of printing on a bent surface.

Figure 20:
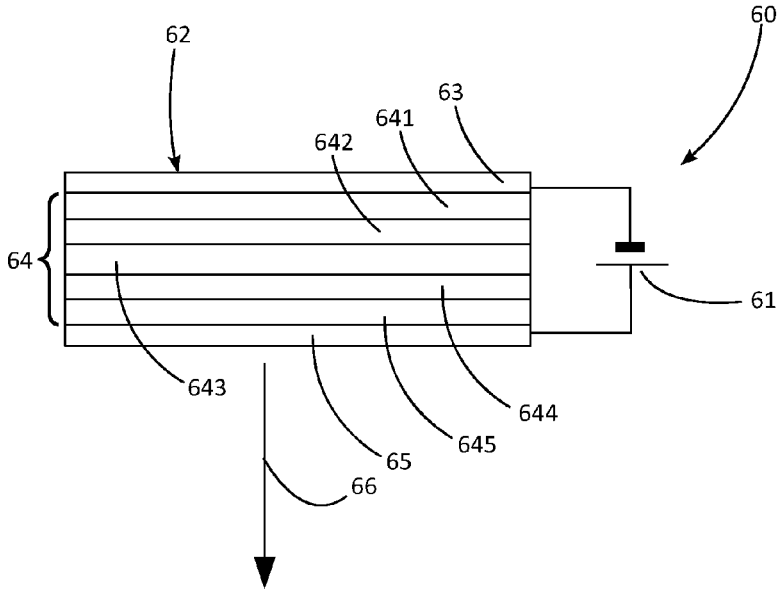

An organic light-emitting diode device 60 of this type is shown in FIG. 20. The device 60 comprises an organic light-emitting diode 62 and an electrical voltage generator 61. The organic light-emitting diode 62 comprises a plurality of layers, namely a cathode 63, an anode 65 and an organic layer 64. When the organic layer 64 is subjected to an electrical voltage, it emits light radiation 66 which is propagated through the anode 65, which is transparent to this radiation. The organic layer 64 may, if required, comprise different strata 641 to 645 made of different organic materials. Preferably, organic light-emitting diodes 62 comprising supplementary strata 641 to 645 are used. In addition to the light-emitting stratum 643, the organic layer 64 comprises a stratum 641 promoting the transport of electrons to the emitting stratum 643 and a stratum 645 promoting the transport of holes to the emitting stratum 643. The organic layer 64 may also comprise a stratum 642 blocking the holes arriving from the lower strata 643 to 645, and a stratum 644 blocking electrons arriving from the upper strata 641 to 643. The set of these strata forms a microcavity whose thickness is adjusted to create optical resonance. Thus, selective interference reflectors are produced, forming resonant cavities. For example, it is possible to use an organic light-emitting diode of the type described in FR 2 926 677, which is equivalent to U.S. Patent Publication 2011/0079772.

The optical device according to the invention can be used, for example, for any of the following functions: signaling the position of the vehicle, signaling a change in direction, signaling reversing, signaling braking, and signaling in case of fog.

If the optical device is inactivated, that is to say if the surface source emits no light, an observer looking at the device face-on sees the light source as if it were present on each of the faces 21 and 25 or 251 to 254. In the case of an organic light-emitting diode, the faces 21 and 25 or 251 to 254 therefore have a metallic appearance.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. An optical device for a motor vehicle, comprising a surface light source for generating a beam having first light rays and second light rays, wherein said optical device comprises a light beam shaping member having at least one first part which deflects said first light rays of said beam emitted by one face of said surface light source, said light beam shaping member having a second part that causes said second light rays of said beam emitted by the same face of said surface light source to pass through said optical device without being deflected so that said second light rays exit said light beam shaping member at substantially the same angle relative to an optical axis of said light beam shaping member as when they entered said light beam shaping member;

wherein said surface light source comprises an organic light-emitting diode situated in generally opposed relation to said second part and emitting light to said at least one first part and said second part;

wherein said at least one first part and said second part are configured to redirect light such that the illumination profile defines a plurality of light bands that are generally elongated and generally parallel;

said at least one first part having a light-emitting surface that forms a non-zero angle relative to a light-emitting surface of said organic light-emitting diode, said optical axis being generally normal to said light-emitting surface, at least a portion of said first light rays received in said at least one first part are internally reflected and do not pass through said second part;

said second part having a curved input surface that is generally concave with respect to said surface light source and in generally opposed relation to said surface light source so that all of said second light rays emitted by said surface light source at less than a predetermined angle relative to said optical axis pass through said curved input surface and are not deflected before they exit said second part.

2. The optical device as claimed in claim 1, wherein said light beam shaping member comprises a deflecting element which deflects the rays by reflection.

3. The optical device as claimed in claim 2, wherein said deflecting element comprises a first reflecting element, notably a first flat reflecting element, and a second reflecting element, notably a second reflecting element with a parabolic section whose focus is at the position of the image of the center of the face seen via said first reflecting element or substantially at the position of the image of the center of the face seen via said first reflecting element.

4. The optical device as claimed in claim 3, wherein said at least one first part comprises an upper part and a lower part, said lower and upper parts being connected by a mechanical connecting element.

5. The optical device as claimed in claim 2, wherein said at least one first part comprises an upper part and a lower part, said lower and upper parts being connected by a mechanical connecting element.

6. The optical device as claimed in claim 5, wherein first and second rays pass through said light beam shaping member.

7. The optical device as claimed in claim 2, wherein said light beam shaping member comprises a deflecting element which deflects the rays mainly by refraction.

8. The optical device as claimed in claim 2, wherein first and second rays pass through said light beam shaping member.

9. The optical device as claimed in claim 1, wherein said light beam shaping member is formed by a transparent one-piece component.

10. The optical device as claimed in claim 9, wherein said light beam shaping member comprises a deflecting element which deflects the rays mainly by refraction.

11. The optical device as claimed in claim 9, wherein first and second rays pass through said light beam shaping member.

12. The optical device as claimed in claim 1, wherein said optical device comprises a housing closed by a closing outer lens, within which housing said surface light source and said light beam shaping member are located.

13. The optical device as claimed in claim 12, wherein said light beam shaping member comprises a deflecting element which deflects the rays mainly by reflection.

14. The optical device as claimed in claim 1, wherein said light beam shaping member comprises a deflecting element which deflects the rays by refraction.

15. The optical device as claimed in claim 14, wherein said at least one first part comprises an upper part and a lower part, said lower and upper parts being connected by a mechanical connecting element.

16. The optical device as claimed in claim 1, wherein an emission area of said surface light source is greater than 1 $cm^2$.

17. The optical device as claimed in claim 1, wherein first and second rays pass through said light beam shaping member.

18. The optical device as claimed in claim 1, wherein said optical device is a lighting device.

19. The optical device as claimed in claim 1, wherein said optical device is a signaling device.

* * * * *